US006732679B2

(12) United States Patent
Iizuka

(10) Patent No.: US 6,732,679 B2
(45) Date of Patent: May 11, 2004

(54) WATER-COOLED INTERNAL COMBUSTION ENGINE

(75) Inventor: Yoshiaki Iizuka, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 33 days.

(21) Appl. No.: 10/146,051

(22) Filed: May 16, 2002

(65) Prior Publication Data

US 2002/0170506 A1 Nov. 21, 2002

(30) Foreign Application Priority Data

May 17, 2001 (JP) ..... P. 2001-148408

(51) Int. Cl.[7] ..... F01P 7/14
(52) U.S. Cl. ..... 123/41.1
(58) Field of Search ..... 123/41.1, 41.84, 123/41.82 R, 41.74, 41.44, 41.72, 41.31, 41.12, 41.13

(56) References Cited

U.S. PATENT DOCUMENTS 4,660,527 A 4/1987 Tanaka et al.
5,076,217 A * 12/1991 Clough ..... 123/41.74
5,113,807 A * 5/1992 Kobayashi ..... 123/41.74

FOREIGN PATENT DOCUMENTS

| | | | |
|---|---|---|---|
| EP | 0 461 765 A1 | 12/1991 | |
| GB | 2 335 483 | 9/1999 | |
| GB | 2348485 A * | 10/2000 | ..... F01P/3/02 |
| JP | 2000-282861 | 10/2000 | |

* cited by examiner

*Primary Examiner*—Tony M. Argenbright
*Assistant Examiner*—Hyder Ali
(74) *Attorney, Agent, or Firm*—Arent Fox Kintner Plotkin & Kahn, PLLC

(57) ABSTRACT

In an internal combustion engine with cylinders and a crankshaft, coolant discharged from a coolant circulating pump is supplied to a coolant jacket formed in a cylinder block via a coolant jacket formed in a cylinder head. An inlet port through which the coolant discharged from the coolant circulating pump flows into the coolant jacket is provided at one end portion of the cylinder head on an intake side thereof in a cylinder-head center line direction, whereas an outlet port through which the coolant in the coolant jacket is allowed to flow out into a heater core is provided at the other end portion of the cylinder head on an exhaust side thereof.

12 Claims, 8 Drawing Sheets

WATER-COOLED INTERNAL COMBUSTION ENGINE

BACKGROUND OF THE INVENTION

1. Field of the Invention

The present invention relates to a water-cooled internal combustion engine in which coolant discharged from a coolant circulating pump is supplied to a block-side coolant jacket formed in a cylinder block via a head-side coolant jacket formed in a cylinder head.

2. Description of the Related Art

Conventionally, an internal combustion engine disclosed in JP-A-2000-282861 is known as an internal combustion engine of a water-cooled type. In this multi-cylinder internal combustion engine, a communicating path is provided at one end portion of a cylinder head in a direction in which cylinders are arranged therein, for guiding coolant discharged from a coolant circulating pump into a coolant jacket, and provided at the other end portion of the cylinder head in the cylinder arrangement direction are a thermostat, a by-pass passage and an outlet port through which coolant flowing out of a coolant jacket in a cylinder block is allowed to flow out into a radiator. Then, a heater core for air conditioning is disposed at an intermediate position between a hose connecting to a downstream portion of the coolant jacket in the cylinder head at a side of the cylinder head in a direction normal to the cylinder arrangement direction and a hose connecting to a downstream portion of a coolant passage formed in the cylinder block. In addition, formed integrally in a thermostat cover which covers the thermostat are an inlet opening to which a radiator hose through which coolant from a radiator flows is connected and an outlet opening to which a radiator hose through which coolant returning to the radiator flows is connected.

On the other hand, a relatively large amount of exhaust gases is returned to an intake system of the internal combustion engine, or an excessive amount of air is supplied to the intake system for lean burning as part of a combustibility improving technology for, for example, improving the combustibility of the internal combustion engine by generating eddy currents in combustion chambers thereof. In such a lean-burn internal combustion engine or an internal combustion engine of a small displacement, there is generated less heat from combustion, and the temperature of coolant for cooling the cylinder head and the cylinder block is not increased to a temperature level which is sufficient to match the heating performance required for an air conditioner designed to employ heat transferred by the coolant.

Then, in order to improve the heater performance, there have been proposed various technologies for increasing the temperature of coolant supplied to the heater core of the air conditioner among which is the provision of an auxiliary heating device along a coolant passage which communicates with the heater core. In an internal combustion engine, however, such as one disclosed in the aforesaid unexamined patent publication, the coolant hose for supplying coolant to the heater core is just connected to the downstream portion of the coolant jacket of the cylinder head and no consideration is taken into for increasing the temperature of the coolant which is supplied to the heater core.

In addition, the coolant hose which connects to the heater core is connected to the cylinder head on a different side of the cylinder head from the side at the other end of the cylinder head where the thermostat cover is mounted, and therefore, this results in the fact that the coolant outlet ports are situated at scattering locations on the cylinder head, leading to a difficulty in performing hose connecting work efficiently. Thus, there has been a demand for improving the situation from the viewpoint of efficient assembly of internal combustion engines.

SUMMARY OF THE INVENTION

The present invention was made in view of the situation, and a common object of first to third aspect of the invention is to improve the heater performance of a water-cooled internal combustion engine in which coolant discharged from a coolant circulating pump is supplied to a block-side coolant jacket formed in a cylinder block via a head-side coolant jacket formed in a cylinder head by increasing the temperature of coolant supplied to a heater core with a simple construction by devising the location of an inlet port formed in the head-side coolant jacket for coolant from the coolant circulating pump and an outlet port for coolant supplied to the heater core. Furthermore, an object of the second aspect of the invention is to have a compact internal combustion engine by providing a compact routing for coolant passage forming members such as hoses connecting to the radiator and the heater core at a portion where an outlet portion for supplying coolant to the heater core is provided. Moreover, an object of the third aspect of the invention is to improve the assembling performance of an internal combustion engine, as well as to reduce the number of components involved by improving the efficiency of connecting work of coolant passage forming member such as hoses connected to the radiator and the heater core.

With a view to achieving the objects, according to the first aspect of the invention, there is provided a water-cooled internal combustion engine with cylinders and a crankshaft in which coolant discharged from a coolant circulating pump is supplied to a block-side coolant jacket formed in a cylinder block via a head-side coolant jacket formed in a cylinder head, the water-cooled internal combustion engine being characterized in that an inlet port through which the coolant discharged from the coolant circulating pump is allowed to flow into the head-side coolant jacket is provided at one end portion in a cylinder-head center line direction and an intake side of the cylinder head, and in that a first outlet port through which the coolant from the head-side coolant jacket is allowed to flow out into a heater core is provided at the other end portion in the cylinder-head center line direction and an exhaust side of the cylinder head.

According to the construction of the first aspect of the invention, since the inlet port is situated at the one end portion in the cylinder-head center line direction and the intake side of the cylinder head and the first outlet port is situated at the other end in the cylinder-head center line direction and the exhaust side of the cylinder head, respectively, the distance between the inlet port and the first outlet port can be made longer within a coolant jacket forming range, whereby the amount of heat that the coolant can receive is increased, thereby making it possible to increase the temperature of the coolant that is supplied to the heater core, resulting in the improvement of the heater performance. Moreover, since the construction for increasing the temperature of the coolant supplied to the heater core depends on the location of the inlet port and the outlet port in the cylinder head, the construction can be made simple. In addition, since the inlet port is situated on the intake side of the cylinder head, intake ports formed in the cylinder head are cooled with coolant whose temperature is lower when compared with a case where the inlet port is made to open on the exhaust side of the cylinder head, whereby the loading efficiency can be improved.

According to the second aspect of the invention, there is provided a water-cooled internal combustion engine as set forth in the first aspect of the invention, wherein an accommodating chamber for accommodating therein a thermostat is provided at the other end portion and an intake side of the cylinder head.

According to the construction of the second aspect of the invention, in addition to the advantage provided by the first aspect, the following advantage is provided. Namely, since the accommodating chamber for accommodating the thermostat is provided at the other end and on the intake side of the cylinder head where a space is formed compared with the exhaust side of the cylinder head where the coolant passage forming members such as the hose for connecting the heater core and the first outlet port are provided, the coolant passage forming members including the coolant passage forming member such as the hose for connecting the thermostat to the radiator can be disposed compact at the other end portion of the cylinder head in the cylinder-head center line direction, thereby making it possible to have the compact internal combustion engine.

According to the third aspect of the invention, there is provided a water-cooled internal combustion engine as set forth in the second aspect of the invention, wherein a thermostat cover for covering the thermostat is provided on a mount surface formed on the other end portion, wherein the accommodating chamber, the first outlet port, and a second outlet port through which the coolant from a main body of the internal combustion engine is allowed to flow out into a radiator are made to open in the mount surface, the accommodating chamber being situated on an intake side and the first outlet port and the second outlet port being situated on an exhaust side of the mount surface, and wherein an inlet passage through which coolant from the radiator is allowed to flow into the thermostat, a first outlet passage through which coolant from the first inlet port is allowed to flow out into the heater core and a second outlet passage through which coolant from the second outlet port is allowed to flow out into the radiator are formed in the thermostat cover.

According to the construction of the third aspect of the invention, in addition to the advantage provided by the second aspect of the invention, the following advantage is provided. Namely, on the mount surface at the other end portion of the cylinder head where the thermostat cover is mounted, the inlet passage, the first outlet passage and the second outlet passage which communicate with the accommodating chamber provided on the mount surface, the first outlet port and the second outlet port, respectively, are formed in the thermostat cover which is single member, and moreover, the inlet passage, the first outlet passage and the second outlet passage are disposed collectively at the other end portion of the cylinder head. Thus, the construction facilitates the connection of the inlet passage, the first outlet passage and the second outlet passage to the coolant passage forming members for connecting those passages to the radiator, the heater core and the radiator, respectively, whereby the efficiency of the connecting work can be improved to thereby improve the assembling efficiency of the internal combustion engine. In addition, the construction obviates the necessity of separately preparing members required to supply the coolant to the heater core such as joints, which reduces the number of components involved, as a result of which man hours associated with the assembly of the joints can be reduced, this contributing to the improvement in the assembling performance of the internal combustion engine.

Note that as used herein, the term "viewed from the top" means viewing from a centrally axial direction of a cylinder bore, and the terms "intake-valve-port side port wall portion" and "exhaust-valve-port side port wall portion" mean, respectively, an intake-port wall and an exhaust-port wall which are included within the range of the cylinder bore as viewed from the top. In addition, the term "cylinder-head center line" means a straight line in the cylinder head when viewing from the centrally axial direction of the cylinder, an imaginary plane including central axes of the cylinder bores and the rotational axis of the crankshaft or an imaginary plane including the central axes of the cylinder bores and being parallel to the rotational axis of the crankshaft. Additionally, the terms "intake side" and "exhaust side" mean, respectively, a side of the cylinder head where inlet ports for the intake ports are situated and the other side of the cylinder where outlet ports for the exhaust ports are situated, relative to the imaginary planes.

DETAILED DESCRIPTION OF THE PREFERRED EMBODIMENTS

Embodiments of the invention will be described below with reference to FIGS. 1 to 8.

Figure 1:
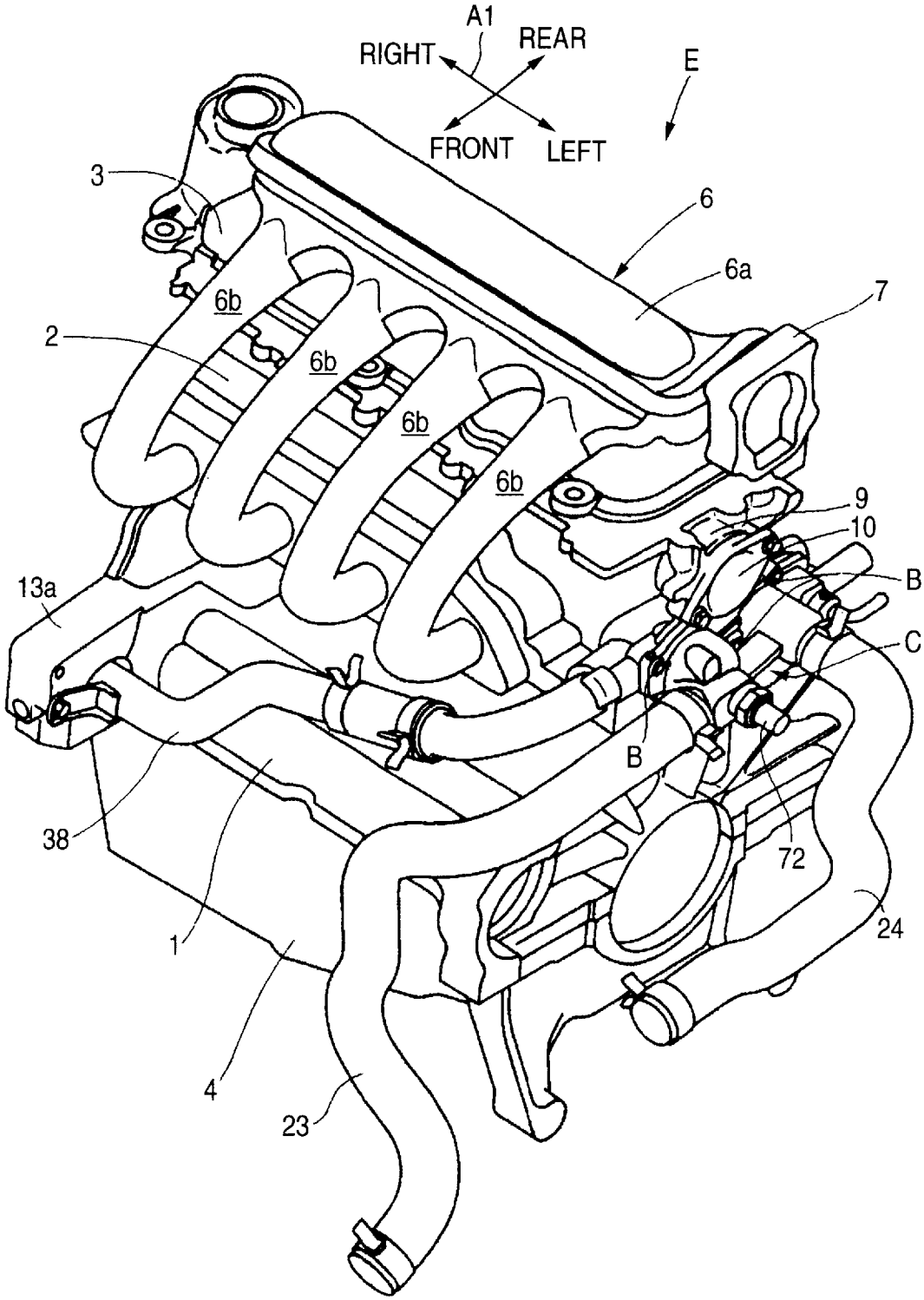
FIG. 1 is a schematic perspective view of an internal combustion engine according to a first embodiment of the invention.

Firstly, referring to FIG. 1, an internal combustion engine E to which a cylinder head according to the invention is applied is an overhead cam, water-cooled, four-cylinder, four-cycle internal combustion engine which is installed in a vehicle with a crankshaft being directed in a transverse direction.

Note that when used in the embodiments, a term "longitudinally and transversely" means "longitudinally and transversely" of a vehicle to which a reference is made.

The internal combustion engine E comprises a cylinder block 1 in which first to fourth cylinders $\mathbf{5}_1$ to $\mathbf{5}_4$ (refer to FIG. 2) are arranged in series which cylinders have cylinder bores 5*a* in which pistons are fitted slidably (refer to FIG. 3), a cylinder head 2 joined to an upper end of the cylinder block 1, a cylinder-head cover 3 joined to an upper end of the cylinder head 2, and an oil pan 4 jointed to a lower end of the cylinder block 1. A main body of the internal combustion engine E is constituted by the cylinder block 1, the cylinder head 2, the cylinder-head cover 3 and the oil pan 4.

Then, an intake manifold 6 is mounted on a front 2*a* of the cylinder head 2 which is an intake side thereof. The intake manifold 6 has a collecting tube 6*a* which is situated directly over the cylinder-head cover 3 and at a left end portion of which a throttle body 7 is provided, and four branch pipes 6*b* which are branched from the collecting tube 6*a* for connection to the front side 2*a* of the cylinder head. The respective branch pipes 6*a* communicate with combustion chambers $\mathbf{8}_1$ to $\mathbf{8}_4$ (refer to FIG. 2) of the respective cylinders $\mathbf{5}_1$ to $\mathbf{5}_4$ via intake ports 40 (refer to FIG. 3) formed in the cylinder head 2. Note that an exhaust manifold (not shown) is mounted on a rear side 2*b* (refer to FIG. 3) of the cylinder head 2 which is an exhaust side thereof.

In addition, although not shown, a power transmission mechanism for rotationally driving a camshaft (not shown) with the power from the crankshaft is provided at one end or a right end of the cylinder block 1 and the cylinder head 2 in a cylinder-head center line direction A1, the camshaft being rotatably supported on the cylinder head 2 within a valve train chamber V (refer to FIG. 4) formed by the cylinder head 2 and the cylinder-head cover 3. A transmission cover for covering the power transmission mechanism is provided on a right-end face of the cylinder block 1 and the cylinder head 2. Furthermore, a cam cover 10 for covering an opening in a cylindrical protruding portion 9 formed on an extension from the camshaft in the axial direction is mounted on the other end or a left end portion of the cylinder head 2 in the cylinder-head center line direction A1 (which coincides with a direction in which the first to fourth cylinders $\mathbf{5}_1$ to $\mathbf{5}_4$ are arranged, and with a transverse direction in this embodiment).

Figure 2:
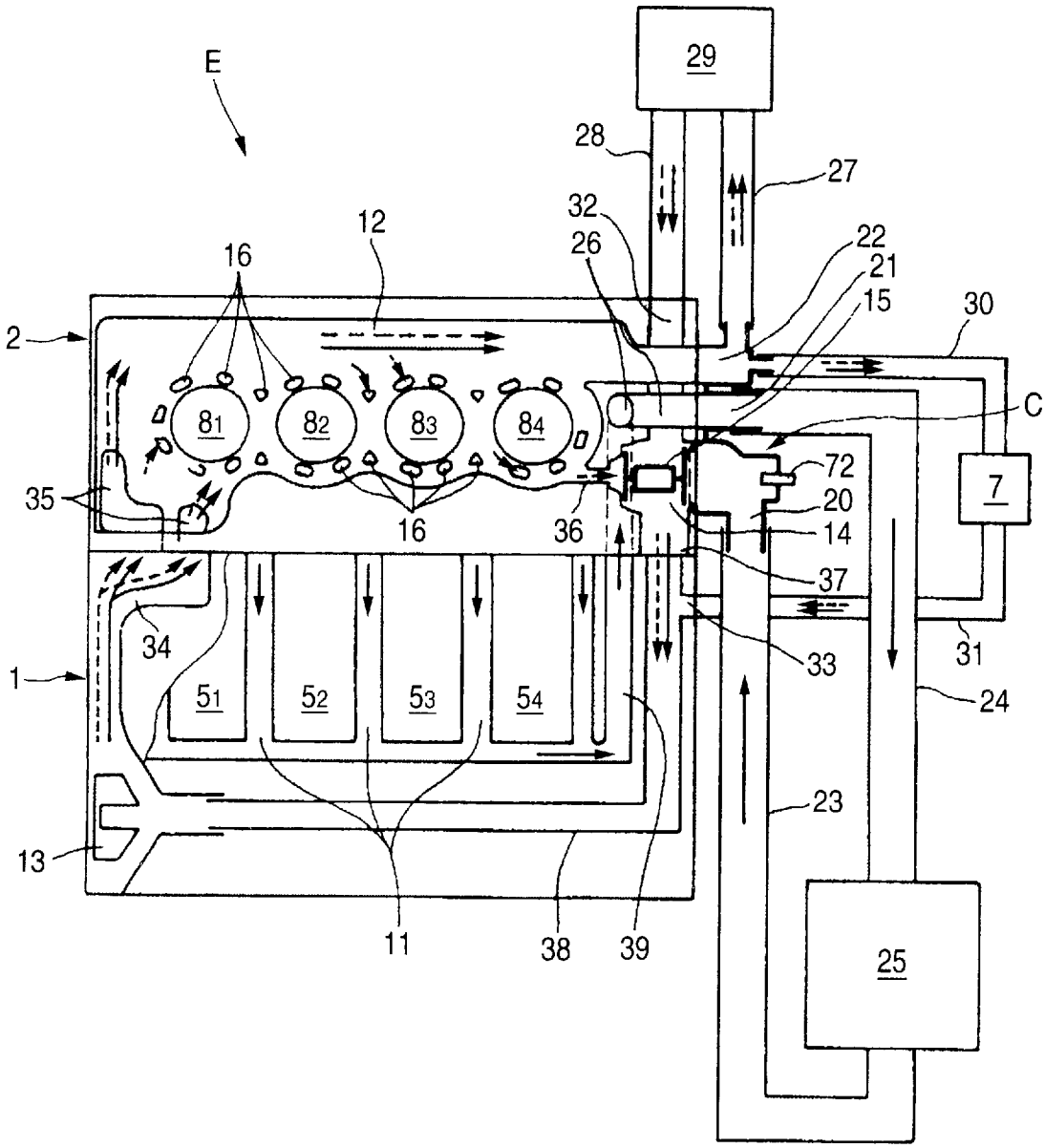
FIG. 2 is an exemplary view of a cooling system for the internal combustion engine in FIG. 1.

Next, mainly referring to FIG. 2, a cooling system for the internal combustion engine E will be described. A coolant circulating pump 13 having a pump body 13*a* (refer to FIG. 1) which is formed integrally with the cylinder block 1 at the right end portion and the front side thereof where a block-side coolant jacket 11 is formed in the cylinder block 1. In addition, a thermostat 15 is provided on the cylinder head 2 in which a head-side coolant jacket 12 is formed in such a manner as to be accommodated in an accommodating chamber 14 which is formed at the left-end portion of the cylinder head 2. Furthermore, the two jackets 11, 12 are made to communicate with each other via a number of communicating paths 16 formed in the cylinder head 2.

A thermostat cover C is mounted on one side or the left end face of the cylinder head 2, and an inlet passage 20 and two outlet passages 21, 22 are formed in the thermostat cover C. Then, the thermostat 15 communicates with a radiator 25 via the inlet passage 20 and a radiator hose 23, and a passage 26 formed in the cylinder head 2 communicates with the radiator 25 via the outlet passage 21 and a radiator hose 24. In addition, the coolant jacket 12 communicates with a heater core 29 for air conditioning via the outlet passage 22 and a hose 27 whereas it communicates with a coolant passage formed in the throttle body 7 via the outlet passage 22 and a hose 30. Furthermore, a return port 32 formed in the cylinder head 2 and an opening 33 formed in a pipe 38, which will be described later, are connected to the heater core 29 and the coolant passage in the throttle body 7 via a hose 28 and a hose 31, respectively. Here, the respective hoses 23, 24, 27, 28, 30, 31 constitute coolant passage forming members.

Then, coolant discharged from the coolant circulating pump 13 flows into the coolant jacket 12 from an inlet port 35 formed in the cylinder head 2 via discharge passage 34 formed in the cylinder block 1. When the internal combustion engine E is in cool operating conditions, since the thermostat 15 cuts the communication between the radiator hose 23 and the accommodating chamber 14, as shown by broken lines in the figure, there is little coolant which flows into the coolant jacket 11 through the communicating path 16, and the coolant in the coolant jacket 12 flows into the accommodating chamber 14 through a by-pass passage 36 formed in the cylinder head 2, while part thereof is supplied to the heater core 29 after flowing through the hose 27 for exchanging heat with air for heating the interior of the passenger compartment. After the heat in the coolant has been transferred the air, the coolant returns to the accommodating chamber 14 via the hose 28 and the return port 32. Furthermore, another part of the coolant in the coolant jacket 12 is supplied to the throttle body 7 after flowing through the hose 30 for heating the throttle body 7 when the engine is not warmed up, and thereafter, the coolant flows into the pipe 38 after flowing through the hose 31. In addition, since the coolant in the accommodating chamber 14 is drawn into the coolant circulating pump 13 via the pipe 38 connecting to an inlet port 37 formed in the cylinder head 2 in such a manner as to open to the accommodating chamber 14, when the engine is in cool operating conditions, the coolant flows through the coolant jacket 12 without flowing through the radiator 25.

In addition, when the internal combustion engine E is in hot operating conditions, since the thermostat 15 establishes a communication between the radiator hose 23 and the accommodating chamber 14 and at the same time shuts the by-pass passage 36, the coolant in the cooling jacket 12 flows into the coolant jacket 11 through the communicating path 16, as indicated by solid lines in the figure, to cool the cylinder block 1 without flowing into the accommodating chamber 14 through the by-pass passage 36. Thereafter, the coolant flows into the radiator 25 via a passage 39 formed in the cylinder block 39 and through the outlet passage 21 and the radiator hose 24. Then, after the temperature thereof is lowered after dissipation of heat in the radiator 25, the coolant flows into the accommodating chamber 14 through the radiator hose 23 via the inlet passage 20 and the thermostat 15. As this occurs, part of the coolant in the coolant jacket 12 is, as when the engine is in cool operating conditions, supplied to the heater core 29 where heat is transferred to air therein and then returns to the accommodating chamber 14. Additionally, the coolant which is supplied to the throttle body 7 is controlled with respect to the flow rate thereof by a control valve (not shown) for preventing the excessive heating of the throttle body 7. Then, the coolant in the accommodating chamber 14 is drawn into the coolant circulating pump 13 via the outlet port 37 and the pipe 38, and when the engine is in hot operating conditions, the coolant that has passed through the radiator 25 flows through the two coolant jackets 11, 12.

Next, referring to FIGS. 3, 4, the construction of the cylinder head 2 will be described. Note that in FIG. 3, the cross sections of an intake port 40 and an exhaust port 41 of the third cylinder $\mathbf{5}_3$ are different from those of the remaining cylinders $\mathbf{5}_1$, $\mathbf{5}_2$, $\mathbf{5}_4$, to show the cross sections thereof which are closer to a combustion chamber $\mathbf{8}_3$.

In the cylinder head 2, combustion chambers $\mathbf{8}_1$ to $\mathbf{8}_4$ (refer to FIGS. 2, 4) are formed in such a manner as to correspond to the first to fourth cylinders $\mathbf{5}_1$ to $\mathbf{5}_4$ in the cylinder block 1, and there are provided an intake port 40 and an exhaust port 41 for each combustion chamber in such a manner as to communicate with the combustion chambers $\mathbf{8}_1$ to $\mathbf{8}_4$, respectively. Each intake port 40 has an intake valve port 40*a* which is made to open to each of the combustion chambers $\mathbf{8}_1$ to $\mathbf{8}_4$ and is opened and closed by an intake valve (not shown) and an inlet port 40*b* which is made to open to the front side 2*a* of the cylinder head 2 and to which the branch pipe 6*b* of the intake manifold 6 is connected. On the other hand, each exhaust port 41 has an exhaust valve port 41*a* which is made to open to each of the combustion chambers $\mathbf{8}_1$ to $\mathbf{8}_4$ and is opened and closed by an exhaust valve 42 (refer to FIG. 4) and an outlet port 40*b* which is made to open to the rear side 2*b* of the cylinder head 2 and to which the exhaust manifold is connected.

Furthermore, formed in the cylinder head 2 in such a manner as to be contiguous with the intake port 40 and the exhaust port 41, respectively, are two mount portions 43, 44 each having insertion holes 43*a*, 44*a* into which two sparking plugs (not shown) facing each of the combustion chambers $\mathbf{8}_1$ to $\mathbf{8}_4$ are inserted. Then, as shown in FIG. 3, the mount portion 43 and the intake port 40 are disposed in that order for each combustion chamber $\mathbf{8}_1$ to $\mathbf{8}_4$ from the other end portion or the right-end portion (situated on the left end as viewed in FIG. 3) of the cylinder head 2 in the cylinder-head center direction A1 on the intake side thereof, whereas the exhaust port 41 and the mount portion 44 are disposed in that order from the right end of the cylinder head 2 on the exhaust side thereof.

Figure 4:
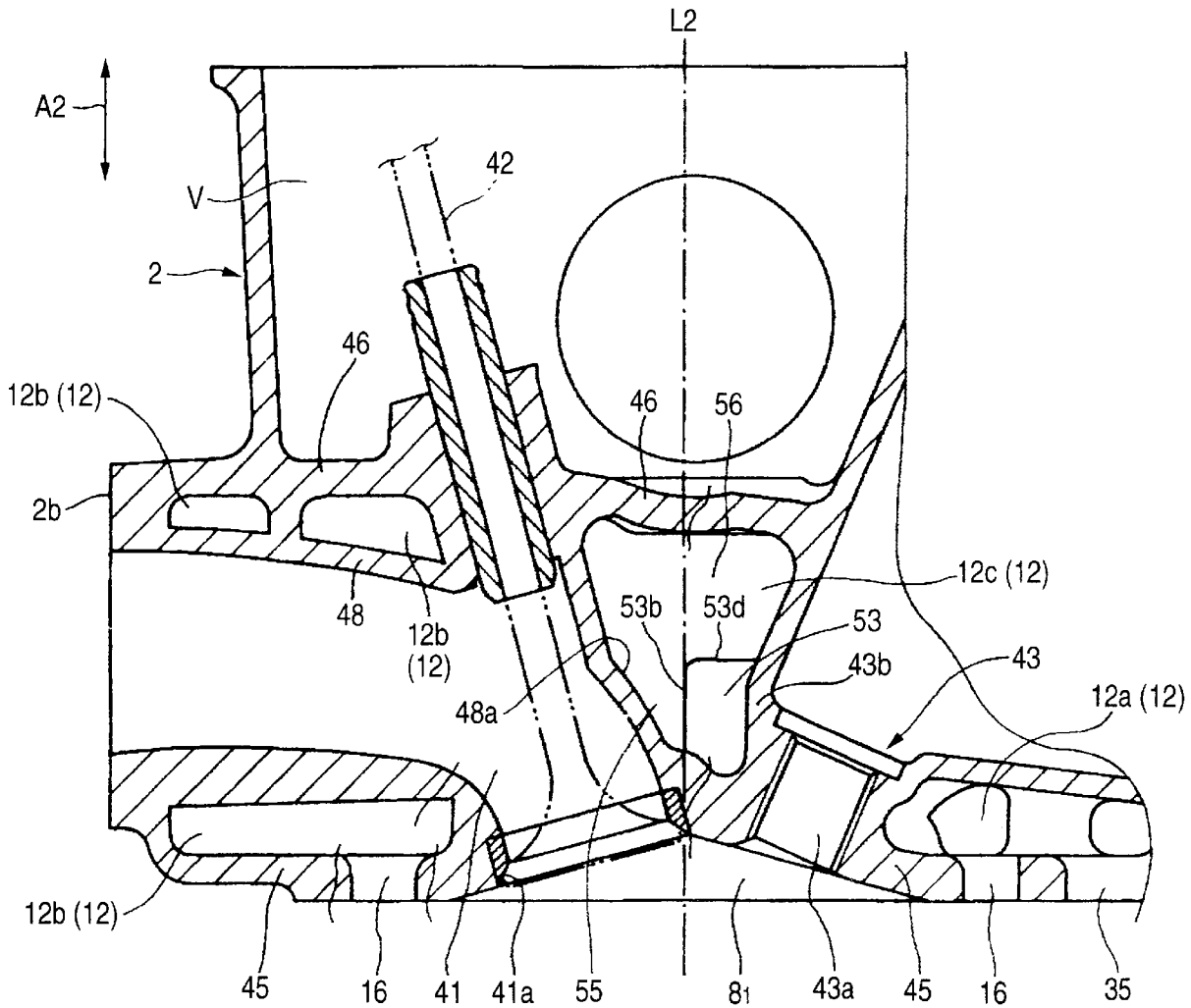
FIG. 4 is a sectional view taken along the line IV—IV in FIG. 3.

Referring also to FIG. 4, the coolant jacket 12 is constituted by a bottom wall 45 which forms a chamber wall of the combustion chamber $\mathbf{8}_1$ to $\mathbf{8}_4$, an upper wall 46 which forms a chamber wall of a valve train chamber V in which a valve train (not shown) constituted by the camshaft and the like for driving the intake valve and the exhaust valve 42 is accommodated, a port wall 47 which forms the intake port 40, a port wall 48 which forms the exhaust port 41 and a wall of the cylinder head 2 which includes walls 43*b*, 44*b* of the mount portions 43, 44 for the two sparking plugs. Then, the coolant jacket 12 comprises an intake-side jacket portion 12*a*, an exhaust-side jacket portion 12*b* and a central jacket portion 12*c*. The intake-side jacket portion 12*a* is situated on the intake side of the cylinder head 2 and extends between the left and right end portions of the cylinder head 12 along the cylinder-head center line A1 at a position closer to the inlet port 40*b* of the intake port 40 than the combustion chamber $\mathbf{8}_1$ to $\mathbf{8}_4$. The exhaust-side jacket portion 12*b* is situated on the exhaust side of the cylinder head and extends between the left and right end portions of the cylinder head 12 along the cylinder-head center line A1 at a position closer to the outlet port 41*b* of the intake port 41 than the combustion chamber $\mathbf{8}_1$ to $\mathbf{8}_4$. The central jacket portion 12*c* extends on the cylinder-head center ling L1 between the left and right end portions of the cylinder head 2 directly on the combustion chamber $\mathbf{8}_1$ to $\mathbf{8}_4$. The central jacket portion 12*c* and the intake-side and exhaust-side jacket portions 12*a*, 12*b* are made to communicate with each other between the adjacent combustion chambers $\mathbf{8}_1$, $\mathbf{8}_2$; $\mathbf{8}_2$, $\mathbf{8}_3$; $\mathbf{8}_3$, $\mathbf{8}_4$, as viewed from the top. Furthermore, at the right end portion of the cylinder head 2, the central jacket portion 12*c* and the intake-side and exhaust-side jacket portions 12*a*, 12*b* are made to communicate with each other via a communicating portion 12*d*.

Then, as shown in FIG. 4, the intake-side jacket portion 12*a* is formed in the intake port 40 on a bottom-wall 45 side thereof and is not formed on an upper-wall 46 side, whereas the exhaust-side jacket portion 12*b* is formed in each exhaust port 41 on the bottom-wall 45 side, the upper-wall 46 side and in a wall between the adjacent exhaust ports 41 in such a manner as to surround the exhaust port 41.

Figure 3:
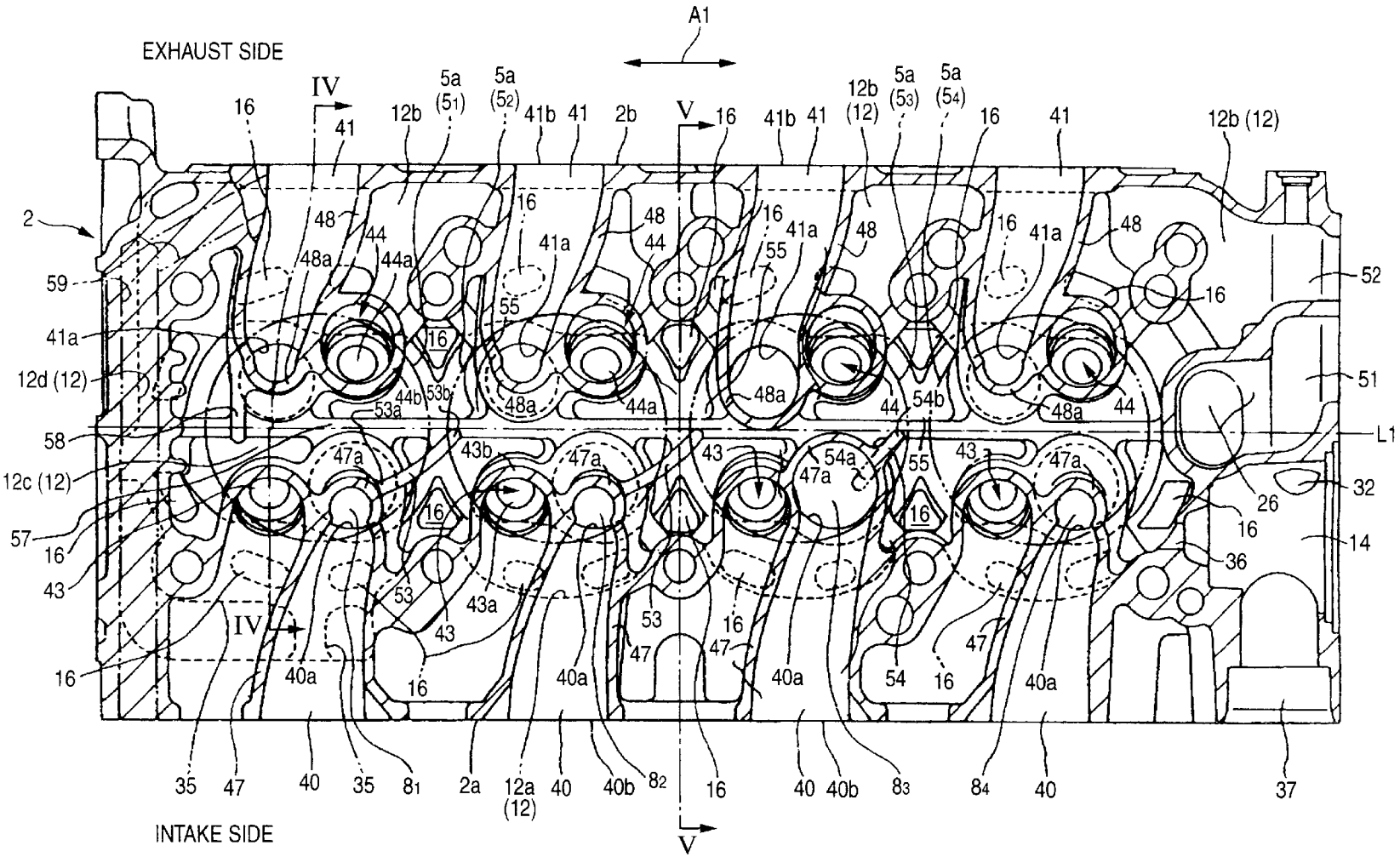
FIG. 3 is a plan sectional view of a cylinder head of the internal combustion engine shown in FIG. 1.

In addition, as shown in FIG. 3, on the intake-side of the right-end portion of the cylinder head 2, the inlet port 35 which communicates with the discharge passage 34 (refer to FIG. 2) at a connecting surface to the cylinder block 1 is formed in such a manner as to open to the intake-side jacket portion 12*a* in the vicinity of the front end portion and the right-end portion of the intake-side jacket portion 12*a*. Additionally, on the intake-side of the left-end portion of the cylinder head 2, the accommodating chamber 14 of the thermostat 15 communicates with the intake-side jacket portion 12*a* via the by-pass passage 36, an outlet port 52 communicating with the hose 27 connected to the heater core 29 is formed to open to the exhaust-side jacket portion 12*b* in the cylinder-head center line direction A1 at the rear-end portion and the left-end portion of the exhaust-side jacket portion 12*b*. Furthermore, an outlet port 51 which communicates with the coolant jacket 11 via the passages 39, 26, as well as the radiator 25 via the radiator hose 24 is formed between the accommodating chamber 14 and the outlet port 52 in a direction normal to the cylinder-head center line direction A1 (hereinafter, referred to as a "normal direction") as viewed from the top. Then, at the left-end portion of the cylinder head 2, an outlet port 37 to which the pipe 38 communicating with the coolant circulating pump 13 is connected is made to open to the front side 2*a* of the cylinder head 2 whereas the return port 32 to which the hose 28 connected to the heater core 29 is connected is made to communicate with the rear side 2*b* thereof. Furthermore, a number of communicating passages 16 are formed around the respective combustion chambers $\mathbf{8}_1$ to $\mathbf{8}_4$ in circumferential directions thereof at certain intervals for supplying coolant discharged from the coolant circulating pump 13 to the coolant jacket 11 via the coolant jacket 12.

Figure 5:
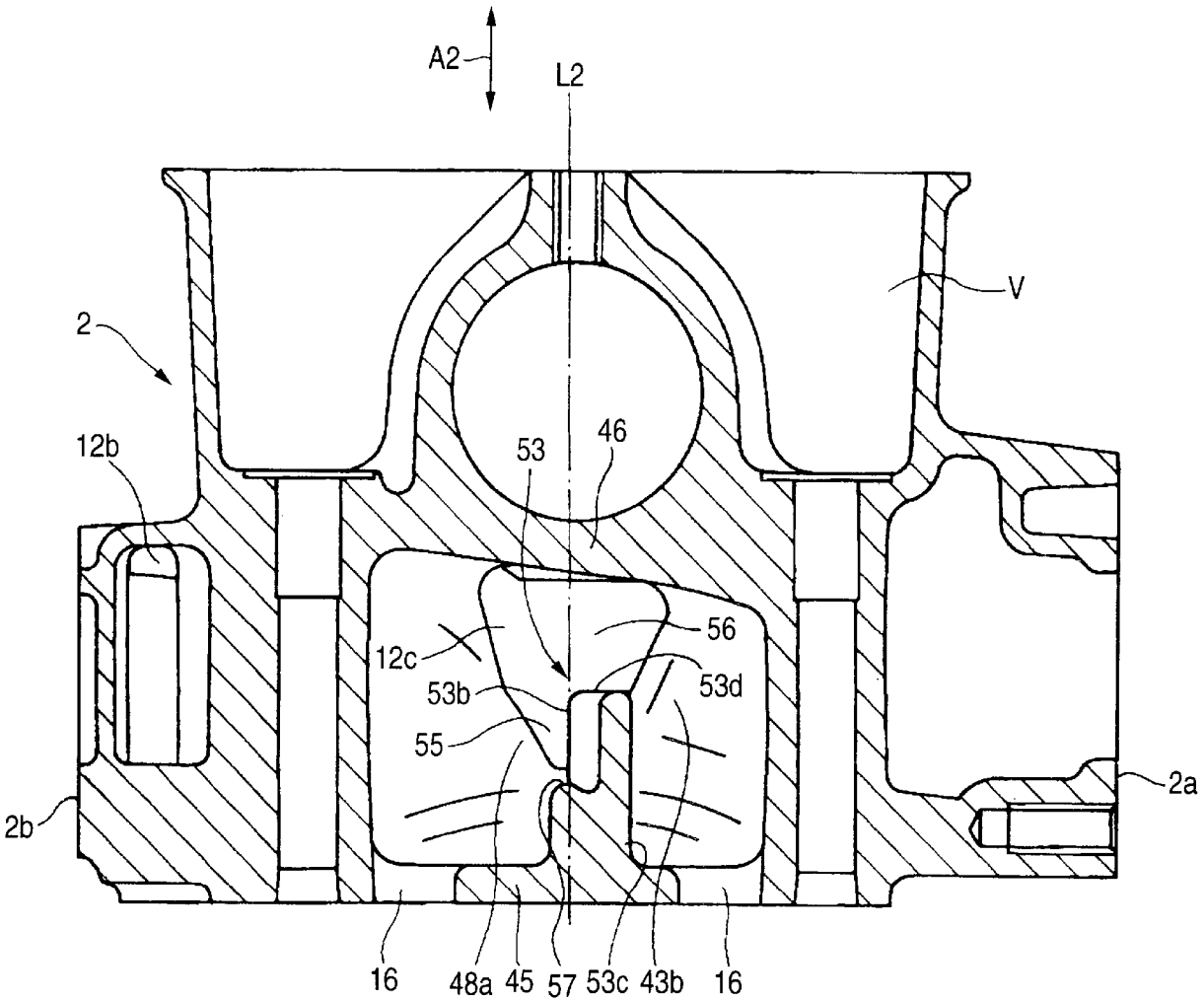
FIG. 5 is a sectional view taken along the line V—V in FIG. 3.

Referring to FIG. 3 mainly together with FIG. 5, of the combustion chambers $\mathbf{8}_1$ to $\mathbf{8}_4$, except for the combustion chamber $\mathbf{8}_4$ of the left end mostly distanced from the inlet port 35 in the cylinder head center line direction A1, in intake-valve-port side port wall portions 47*a* of the port walls 47 forming the intake ports 40 respectively communicating with the combustion chambers $\mathbf{8}_2$; $\mathbf{8}_3$; $\mathbf{8}_4$ positioned from the inlet port 35 toward the downstream of the coolant flow in that order, plate-like deflecting ribs 53, 54 are integrally formed with the cylinder head 2 at portions close to the adjacent combustion chambers $\mathbf{8}_2$; $\mathbf{8}_3$; $\mathbf{8}_4$ at the downstream side of the coolant.

In the combustion chambers $\mathbf{8}_1$, $\mathbf{8}_2$; $\mathbf{8}_2$, $\mathbf{8}_3$; $\mathbf{8}_3$, $\mathbf{8}_4$ which are contiguous with each other in the cylinder-head center line direction A1, of deflecting ribs 53, 54 provided between the intake-valve-port side port wall portion 47*a* of the combustion chambers $\mathbf{8}_1$; $\mathbf{8}_2$; $\mathbf{8}_3$ which are situated on an upstream side of the coolant flow and an exhaust-valve-port side port wall portion 48*a* of the combustion chambers $\mathbf{8}_2$; $\mathbf{8}_3$; $\mathbf{8}_4$ which are situated downstream of the combustion chambers $\mathbf{8}_1$; $\mathbf{8}_2$; $\mathbf{8}_3$, the deflecting rib 53 for the two chambers $\mathbf{8}_1$; $\mathbf{8}_2$ is provided in such a manner as to protrude upwardly from the bottom wall 45, extends in a curved fashion toward the exhaust-valve-port side port wall portion 48*a* of the port wall 48 which forms the exhaust port 41 of the combustion chambers $\mathbf{8}_2$; $\mathbf{8}_3$ which are contiguous therewith on the downstream side. The deflecting rib 53 has a proximal portion 53*a*, a distal portion 53*b* and a lower portion 53*c* and an upper end portion 53*d*. The proximal portion 53*a* is a portion connecting to the intake-valve-port side port wall portion 47. The distal portion 53*b* is an end portion facing the exhaust-valve-port side port wall portion 48*a*. The lower portion 53*c* is a portion connecting to the bottom wall 45, whereas the upper end portion 53*d* is an end portion facing the upper wall 46.

Then, the distal portion 53*b* substantially reaches the imaginary plane and has a predetermined height in a centrally axial direction A2 which is a direction of a central axis of the cylinder bore 5*a*, or, a height in this embodiment in which the upper end portion 53*d* is situated at a position which is slightly lower than a central position of the central jacket portion 12*c* in the centrally axial direction A2.

Each deflecting rib 53 is formed in such a manner as to leave a gap between the distal end portion 53*a* and the exhaust-valve-port side port wall portion 48*a* for allowing the coolant flowing through the central jacket portion 12*c* to flow along wall surfaces of the bottom wall 45 and the exhaust-valve-port side port wall portion 48*a*. Furthermore, a gap 56 is also formed between the upper end portion 53*d* and the upper wall 46.

The deflecting rib 54 extending from the intake-valve-port side port wall portion 47*a* for the combustion chamber $\mathbf{8}_3$ which corresponds to the third cylinder $\mathbf{5}_3$ differs from the deflecting rib 53 in that the rib is formed into a flat plate-like configuration and that it extends over a shorter distance toward the exhaust-valve-port side port wall portion 48*a*. These differences are caused by the fact that the deflecting rib 54 is provided on the intake-valve-port side port wall portion 47*a* which is situated at a position close to the downstream end portion of the coolant jacket 12 and the fact that the flow rate of the coolant flowing in the central jacket portion 12*c* in the cylinder-head center line direction A1 becomes smaller in the vicinity of the deflecting rib 54 compared with the flow rate in the vicinity of the deflecting rib 53 which is situated upstream of the deflecting rib 54. However, the cooling effect provided by the deflecting rib 54 on the exhaust-valve-port side port wall portion 48*a* is substantially equal to that provided by the deflecting rib 53.

Thus, the configuration and the location of the deflecting ribs 53, 54 are suitably set with a view to mainly attaining the improvement in cooling effect on the exhaust-valve-port side port wall portion 48*a* by deflecting the flow of coolant toward the exhaust-valve-port side port wall portion 48*a*.

Thus, the respective deflecting ribs 53, 54 allow of the coolant flowing in the central jacket portion 12*c* between the intake-valve-port side port wall portions 47*a* and the exhaust-valve-port side port wall portions 48*a* of the respective combustion chambers $\mathbf{8}_1$ to $\mathbf{8}_4$, the coolant which flows at positions closer to the bottom wall 45 and the intake-valve-port side port wall portions 47*a* to flow toward the exhaust-valve-port side port wall portions 48*a* of the combustion chambers $\mathbf{8}_2$; $\mathbf{8}_3$; $\mathbf{8}_4$ which contiguous with each other on the downstream side while allowing the coolant which flows at a position closer to the upper wall 46 of the central jacket portion 12*c* to flow in the cylinder-head central direction A1 through the gap 56.

In addition, a central rib 57 extending linearly continuously along the imaginary plane between the left-end and right-end portions of the cylinder head 12 is formed on the imaginary plane (on the cylinder head center line L1 as viewed from the top) in such a manner as to protrude from the bottom wall 45 to a height which is lower than the deflecting ribs 53, 54. Then, the distal portions 53*b*, 54*b* of the deflecting ribs 53, 54 are connected to the central rib 57.

Furthermore, a rib 58 is formed on the exhaust-valve-port side port wall portion 48*a* of the combustion chamber $\mathbf{8}_1$ which is closest to the inlet port 35 situated at the right-end portion of the cylinder head 2 at a position closer to a communicating portion 12*d*. The rib extends toward the mount portion 43 in the normal direction to reach the imaginary plane and has a height which is substantially equal to those of the deflecting ribs 53, 54. Then, part of the coolant which flows from the inlet port 35 toward the central jacket portion 12*c* is deflected by this rib 58 to be allowed to flow toward the exhaust jacket portion 12*b*.

In addition, an exhaust gas outtake passage 59 of an exhaust gas recirculating device for recirculating exhaust gases to the intake system of the internal combustion engine E is made to open to the exhaust port 41 of the combustion chamber $\mathbf{8}_1$ which is closest to the right-end portion of the cylinder head 2. This exhaust gas outtake passage 59 extends along the communicating portion 12*d* of the coolant jacket 12 in a direction normal to the imaginary plane while passing over the inlet port 35 to thereby open in the front side 2*a* of the cylinder head 2. Furthermore, the passage 59 communicates with a recirculation control valve (not shown) for controlling the amount of coolant which is recirculated to the induction system.

Figure 6:
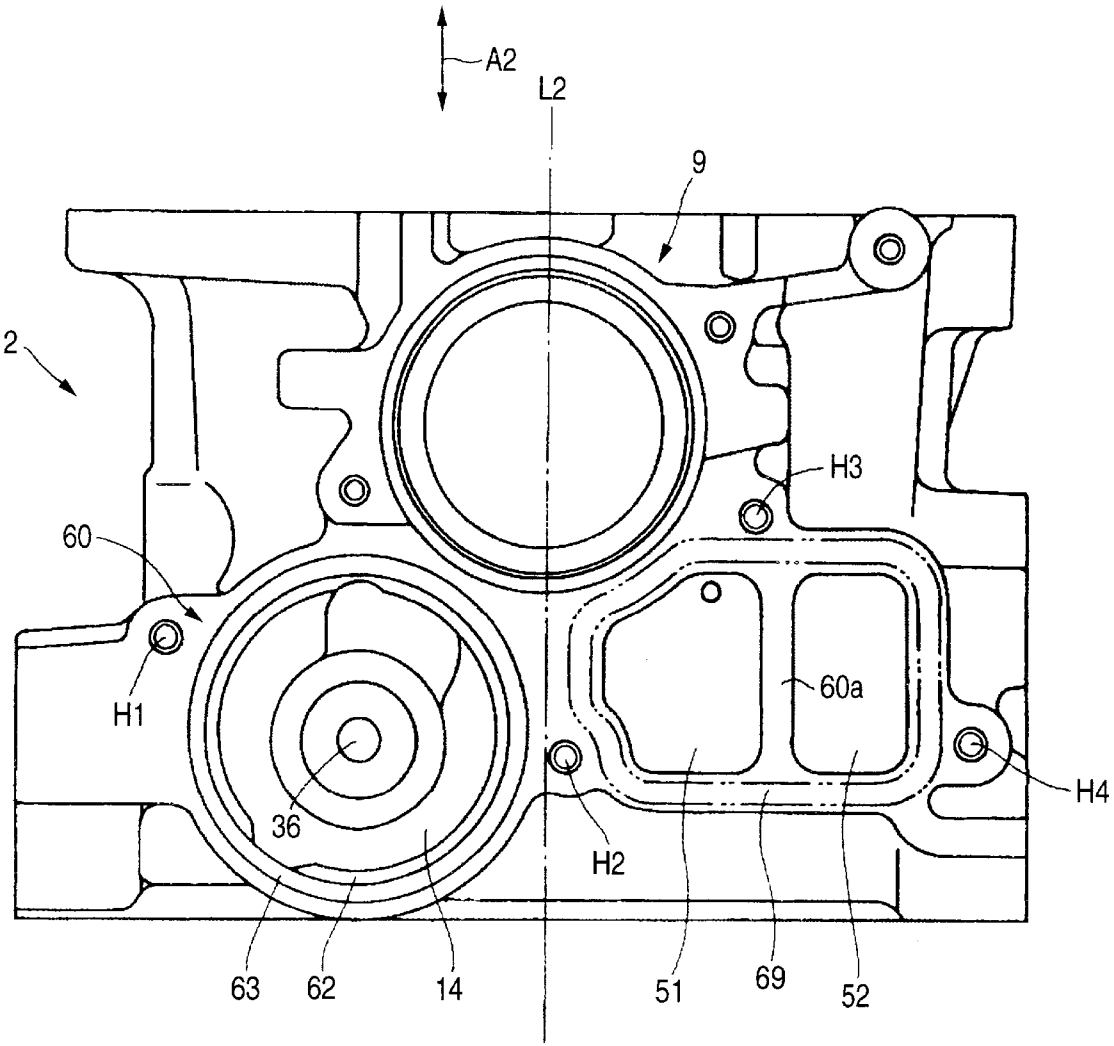
FIG. 6 is a left-hand side view of the cylinder head of the internal combustion engine shown in FIG. 1.
Figure 7:
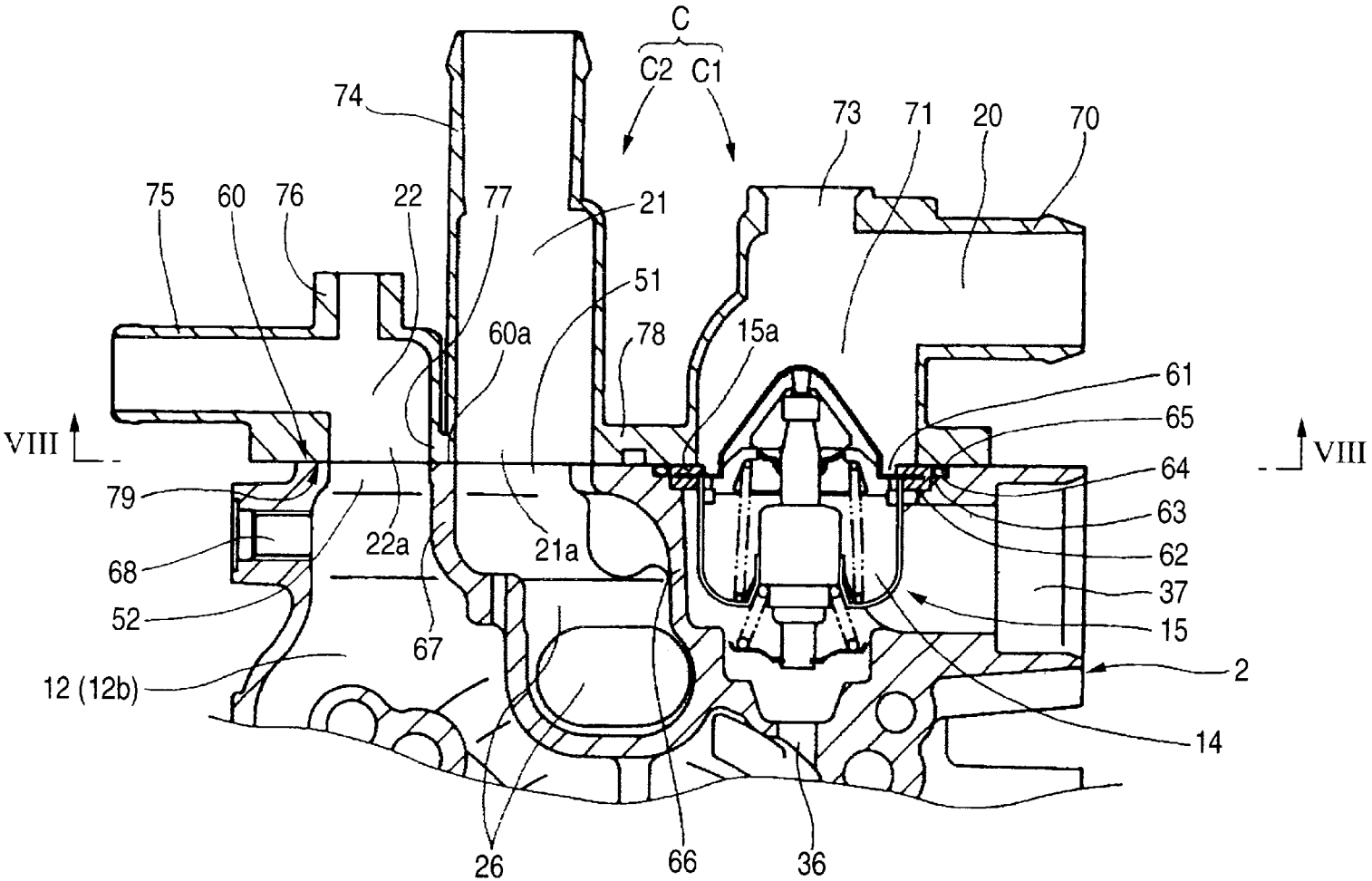
FIG. 7 is a plan sectional view showing a main portion at a left end portion of the cylinder head of the internal combustion engine shown in FIG. 1 in which a thermostat cover is mounted.
Figure 8:
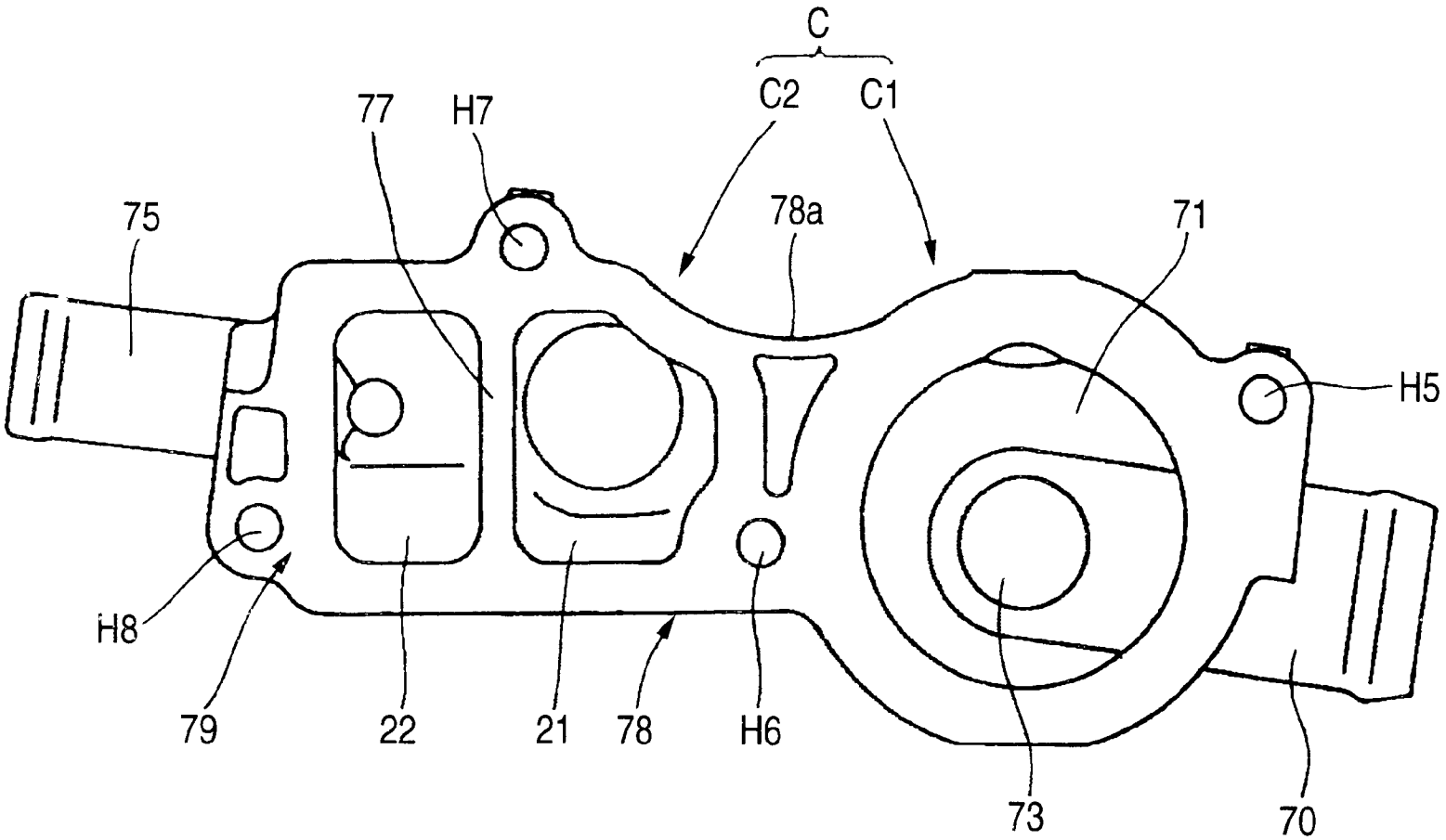
FIG. 8 is a view as seen in a direction indicated by arrows VIII—VIII in FIG. 7.

Next, referring to FIGS. 6 to 8, described will the thermostat cover C which is mounted at the left-end portion of the cylinder head 2.

Referring to FIGS. 6, 7, a mount surface 60 is formed on a left-end face of the cylinder head 2 where the thermostat cover C is mounted. The accommodating chamber 14 formed at the left-end portion of the cylinder head 2 and comprising a recessed portion is situated on the intake-side of the cylinder head 2 and downward and ahead of the protruding portion 9 which is situated on the axial extension from the camshaft and has an inlet port 61 which also constitutes an opening thereof which is made to open in the mount surface 60. A stepped portion 62 is formed on a circumferential edge portion of the inlet port 61 on which an annular holding portion 15*a* of the thermostat 15 is placed, whereby the thermostat 15 is fixed to the cylinder head 2 when the holding portion 15*a* is held between the stepped portion 62 and the thermostat cover C. Thus, the thermostat 15 and the accommodating chamber 14 are provided on the intake side of the cylinder head 2 so that they are situated on the same side of the coolant circulating pump 13 which is provided on the intake side of the cylinder block 1.

Then, a stepped portion 63 which is shallower than the stepped portion 62 is formed on the outer circumferential side of the stepped portion 62, and an annular resilient packing 65 of a synthetic rubber or synthetic resin such as an O ring is fitted in an annular groove 64 formed by the stepped portion 63 and the holding portion 15*a*.

The communicating passage 26, which is situated rearward of the accommodating chamber 14 via a partition wall 66 has the outlet port 51 which is made to open in the mount surface 60. The outlet port 52 of the coolant jacket 12 is made to open rearward of the outlet port 51 with a partition surface 60*a*, which constitutes part of the mount surface 60, of a partition wall 67 extending in the centrally axial direction A2 being held between the coolant jacket 12 and the passage 26. In addition, a mount hole 68 is formed in such a manner as to open from the rear side 2*b* of the cylinder head 2 to the outlet port 52 for receiving therein a coolant temperature sensor for detecting the temperature of coolant at the outlet port 52.

Furthermore, a liquid packing 69 comprising a silicon material which is a sealing material for, for example, FIPG is applied to a non-circular annular application area on circumferential edge portions of the two outlet ports 51, 52 on the mount surface 60 except for the partition surface 60*a*.

On the other hand, referring to FIGS. 1, 7 and 8, the thermostat cover C attached to the mount surface 60 has a first cover portion C1 forming an accommodating chamber 71 for accommodating part of the thermostat 15 so that the thermostat 15 and the inlet port are covered and a second cover portion C2 for covering the two outlet ports 51, 52. The thermostat cover C is integrally cast of an aluminum alloy. Furthermore, four through holes H5 to H8 are formed at positions corresponding to threaded holes H1 to H4 (refer to FIG. 6) formed in the mount surface 60 so that four bolts B (refer to FIG. 1) are put therethrough in order to fasten the thermostat cover C to the cylinder head 2 therewith.

Then, formed in the first cover portion C1 are a connecting portion 70, the inlet passage 20 and a mount hole 73. The connecting portion 70 is connected to the radiator hose 23 (refer to FIG. 2). The inlet passage 20 is adapted to communicate with the radiator hose 23 for allowing the coolant cooled in the radiator 25 to flow into the accommodating chamber 71 accommodating part of the thermostat 15 and further to the inlet port 61. A temperature switch 72 (refer to FIG. 1) for detecting the temperature of the coolant from the radiator 25 is attached to the mount hole 73.

On the other hand, formed on the second cover portion C2 are a connecting portion 74 to which the radiator hose 24 is connected and which is situated at a position closer to the first cover portion C1 and a connecting portion 75 to which the hose 27 (refer to FIG. 2) is connected to and which is situated rearward of the connecting portion 74. Further, in the second cover portion C2, the outlet passage 21 and the outlet passage 22 are formed in such a manner as to be partitioned by a partition wall 77. The outlet passage 21 has an inlet port 21*a* which substantially aligns with the outlet port 51 and is adapted to communicate with the radiator hose 24 (refer to FIG. 2) so that coolant from the outlet port 51 is allowed to flow into the radiator 25. The outlet passage 22 has an inlet port 22*a* which substantially aligns with the outlet port 52 and is adapted to communicate with the both hoses 27, 30 so that coolant from the outlet port 52 is allowed to flow into the heater core 29 and the throttle body 7, respectively.

Furthermore, a flange 78 of the thermostat cover C has a mount surface 79 which is adapted to be brought into abutment with the mount surface 60 of the cylinder head 2 to mate therewith, and constitutes part of the first and second cover portions C1, C2. The flange 78 has a curved recessed portion 78*a* that corresponds to the configuration of an outer circumferential surface of a lower portion of the protruding portion 9, whereby the camshaft and the thermostat 15 and both outlets 51, 52 can be disposed as close to each other as possible in the centrally axial direction A2 by allowing the lower portion of the protruding portion 9 to be fitted in the recessed portion 78.

Next, described below will be the function and effectiveness of the first embodiment which is constructed as has been described heretofore.

As shown in FIG. 3, coolant flowing into the coolant jacket 12 from the inlet port 35 situated at the front-end portion and the right-end portion and in the vicinity thereof of the coolant jacket 12 is directed to the central jacket portion 12*c* and the exhaust-side jacket portion 12*b* after flowing through the communicating portion 12*d* while flowing through the intake-side jacket portion 12*a*. Of these flows of coolant, since part of the coolant directed to the central jacket portion 12*c* is deflected by the rib 58 so as to be directed to the exhaust-side jacket portion 12*b*, more coolant is allowed to flow through the exhaust-side jacket portion 12*b*. Thus, the coolant is allowed to flow in the respective jacket portions 12*a*, 12*b*, 12*c* toward the left-end portion of the cylinder head 12 and when the engine is in hot operating conditions, part of the coolant flows into the coolant jacket 12 in the cylinder block from the communicating passage 16.

Then, the flows of coolant flowing in the central jacket portion 12*c* at the positions closer to the bottom wall 45 and the intake-valve-port side port wall portion 47*a* are deflected by the deflecting ribs 53, 54 toward the exhaust-valve-port side port wall portions 48*a* of the combustion chambers $\mathbf{8}_2$; $\mathbf{8}_3$; $\mathbf{8}_4$ which are contiguous with the combustion chambers $\mathbf{8}_1$; $\mathbf{8}_2$; $\mathbf{8}_3$ situated on the downstream side thereof, respectively. Then, the coolant so deflected flows against the exhaust-valve-port side port wall portions 48*a*, and thereafter the coolant that has so flowed joins the coolant in the exhaust-side jacket portion 12*b*.

In the exhaust-side jacket portion 12*b*, the coolant flows on the bottom wall 45 side and the upper wall 46 side relative to each exhaust port 41 and between the adjacent walls of the exhaust ports 41 toward the left-end portion of the cylinder head 2. Then, the coolant flows out from the outlet port 52 situated on the rear-end portion and the left-end portion of the cylinder head 2 toward the heater core 29 and the throttle body 7.

As this occurs, as shown in FIGS. 4, 5, the deflecting ribs 53, 54 are provided between the intake-valve-port side port wall portions 47*a* of the combustion chambers $\mathbf{8}_1$; $\mathbf{8}_2$; $\mathbf{8}_3$ which are situated on the upstream side of the flow of coolant and the exhaust-valve-port side port wall portions 48*a* of the combustion chambers $\mathbf{8}_2$; $\mathbf{8}_3$; $\mathbf{8}_4$ which are situated downstream of the combustion chambers $\mathbf{8}_1$; $\mathbf{8}_2$; $\mathbf{8}_3$ in such a manner as to protrude upwardly from the bottom wall 45. Further, the deflecting ribs 53, 54 are formed in such a manner as to leave the gaps 55 between the exhaust-valve-port side port wall portions 48 and themselves, respectively, so that the coolant flows on the respective walls of the bottom wall 45 including the central rib 57 and the exhaust-valve-port side port wall portion 48*a*, whereby there is no risk that the coolant stagnates on the respective wall surfaces of the bottom wall 45 and the exhaust-valve-port side port wall portion 48*a* at the portion where the gap 55 is formed.

As a result, since part of the coolant is deflected to flow toward the exhaust-valve-port side port wall portion 48*a* which has the highest heat load among the walls of the cylinder head 2 forming the coolant jacket 12, the cooling effect on the exhaust-valve-port side port wall portion 48*a* is improved, and being different from the case where the conventional continuous rib is used, there is caused no stagnation of coolant on the respective walls of the bottom wall 45 and the exhaust-valve-port side port wall portion 48*a* at the position where the gap 55 is formed. Furthermore, part of the coolant flows around the back of the deflecting ribs 53, 54 from the gap 55, whereby since an area on the wall of the bottom wall 45 where the stagnation of coolant is generated is reduced, the area where the stagnation of coolant is generated by the deflecting ribs 53, 54 is in turn reduced, the cooling effect on the bottom wall 45 and the exhaust-valve-port side port wall portion 48*a* being thereby improved, this allowing the portion having the highest heat load to be cooled effectively. The amount of heat received by the coolant is increased by the effective cooling of the wall 45 and the exhaust-valve-port side port wall portion 48*a*. Thus, the heater performance is improved when the coolant whose temperature is so increased is supplied to the heater core 29.

Since the central rib 57 is provided on the bottom wall 45 of the cylinder head 2 which protrudes upwardly from the bottom wall 45 and extends in the cylinder-head center line direction A1 between the left- and right-end portions of the cylinder head 2, the coolant flowing between the intake-valve-port side port wall portion 47*a* and the exhaust-valve-port side port wall portion 48*a* of the cylinder head 2 is allowed to flow downstream while being straightened along the cylinder-head center line L1, whereby the chamber wall of the combustion chamber $8_1$ to $8_4$ constituted by the bottom wall 45, the intake-valve-port side port wall portion 47*a* and the exhaust-valve-port side port wall portion 48*a* can be cooled substantially equally. In addition, the central rib 57 and the deflecting ribs 53, 54 connecting to the central rib 57 contribute to the improvement in rigidity of the entirety of the cylinder head 2. Furthermore, since the central rib 57 and the deflecting rib 53 are provided to extend over the contiguous combustion chambers $8_1$, $8_2$; $8_2$, $8_3$, they contribute to the improvement in rigidity of the cylinder head 2 at portions between the combustion chambers $8_1$, $8_2$; $8_2$, $8_3$.

Since the respective jacket portions 12*a*, 12*b*, 12*c* are formed in such a manner as to extend along substantially the cylinder-head center line direction A1 between both the left- and right-end portions of the cylinder head 2, and moreover, the inlet port 35 is situated at the positions at the front-end portion and the right-end portion and in the vicinity thereof of the coolant jacket 12 at the right-end portion of the cylinder head 2 on the intake side thereof whereas the outlet port 52 is situated at the rear-end portion and the left-end portion of the coolant jacket 12 at the left-end portion of the cylinder head 2 on the exhaust-side thereof, the distance between the inlet port 35 and the outlet port 52 can be extended within the range where the coolant jacket 12 is formed, whereby the amount of heat received by the coolant is increased, and the temperature of the coolant supplied to the heater core 29 is in turn increased, the heater performance being thereby improved. Moreover, since the construction for increasing the temperature of the coolant that is supplied to the heater core 29 depends on the location of the inlet port 35 and the outlet port 52, the construction thereof is simple.

In addition, since the inlet port 35 is situated on the intake side of the cylinder head 2, when compared with a case where an inlet port for coolant discharged from the coolant circulating pump 13 is made to open in the exhaust side of the cylinder head 2, the intake port 40 formed in the cylinder head 2 is cooled by coolant having a lower temperature, whereby the loading efficiency is improved.

Furthermore, since the outlet port 52 is made to open in the exhaust-side jacket portion 12*b* which extends while surrounding the exhaust ports 41 having the higher heat load and moreover since the by-pass passage 36 is made to open in the intake-side jacket portion 12*a*, it can be suppressed that the temperature of the coolant in the intake-side jacket portion 12 is lowered by the coolant in the exhaust-side jacket portion 12*b*, thereby making it possible to maintain high the temperature of the coolant flowing out of the outlet port 52. The heater performance can be improved in this respect. In addition, the outlet port 51 is interposed between the outlet port 52 and the accommodating chamber 14 at the left-end portion of the cylinder head 2. And, the outlet port continues to the passage 26 through which the coolant passes which is heated when it passes through the coolant jacket 12 and is then heated further when passing through the coolant jacket 11. Thus, the heat of the coolant passing through this outlet port 51 is transferred to the coolant which passes through the outlet port 52 via the partition wall 67, whereby the temperature of the coolant supplied to the heater core 29 is in turn increased, thereby making it possible to improve the heater performance.

Furthermore, since the outlet port 52 is formed in such a manner as to open in the exhaust-side jacket portion 12*b* in the cylinder-head center line direction A1, the stagnation of the coolant flowing in the exhaust-side jacket portion 12*b* formed along substantially the cylinder-head direction A1 is suppressed, whereby the coolant is allowed to flow toward the outlet port 52 smoothly, whereby the cooling effect is improved on the cylinder head 2 and, in particular, on the exhaust side thereof having the higher heat load.

In addition, at the left-end portion of the cylinder head 2, since the accommodating portion 14 for accommodating therein the thermostat 15 is disposed on the intake-side of the cylinder head 2 where the space is formed rather than on the exhaust side thereof where the hoses 24, 27 are disposed which are intended to make the radiator 25 and the heater core 20 communicate with the outlet port 51 and the outlet port 52, the disposition of the hoses at the left-end portion of the cylinder head 2 including the radiator hose 23 for connecting the thermostat 15 to the radiator 25 can be made compact, whereby the internal combustion engine E can be made compact in turn.

Since the thermostat 15 is provided at the left-end portion of the cylinder head 2 rather than at the right-end portion thereof where the valve train mechanism is provided for rotationally driving the camshaft, there is no limitation imposed by the members disposed around the routing of the radiator hose 23 for allowing the coolant to flow into the thermostat 15, whereby the internal combustion engine can be made compact. Moreover, since the thermostat 15 and the accommodating chamber 14 are provided on the intake side of the cylinder block 1 whereas the coolant circulating pump 13 is provided on the intake side of the cylinder head 2, the thermostat 15 and the coolant circulating pump 13 can be situated on the same side relative to the main body of the internal combustion engine E, whereby the distance from the thermostat 15 to the coolant circulating pump 13 can be shortened, thereby making it possible to make the internal combustion engine E compact.

Formed on the first cover portion C1 of the thermostat cover C on which the first and second cover portions C1, C2 is formed integrally the inlet passage 20 for allowing the coolant from the radiator 25 to flow into the inlet port 61 accommodating the thermostat 15 with the radiator hose 23 being connected to the connecting portion 70, whereas formed on the second cover portion C2 are the outlet passage 21 for allowing the coolant from the outlet port 51 to flow out into the radiator 25 with the radiator hose 24 being connected to the connecting portion 74 and the outlet passage 22 for allowing the coolant from the outlet port 52 to flow out into the core heater 29 and the throttle body 7 with the hoses 27, 30 being connected to the connecting portions 75, 76, respectively. Thus, on the mount surface 60 the connecting portions 70, 74, 75, 76 to which the hoses 23, 24, 27, 30 for establishing communications between the inlet port 61 and the two outlet ports 51, 52 which are formed in the mount surface 60 and the radiator 25, the heater core 29 and the throttle body 7 are formed on the thermostat cover C which is the single member, and moreover, they are collectively disposed at the left-end portion of the cylinder head 2, whereby the connection of the respective hoses 23, 24, 27, 30 is facilitated through which the coolant is allowed to flow, the working efficiency being thereby improved. This helps improve the assembling performance of the internal combustion engine E and obviates the necessity of preparation of members required for the supply of the coolant to the heater core 29 and the throttle body 7 such as joints, whereby the number of components involved can be reduced. As a result, the man hours associated with the assembly of the joints can be reduced, and in this respect the assembling performance of the internal combustion engine can be improved.

Furthermore, since the recessed portion 78*a* is formed in the flange portion 78 of the thermostat cover C for receiving therein the lower portion of the protruding portion 9 which protrudes from the left-end portion of the cylinder head 2, the camshaft and the thermostat 15 and the outlet ports 51, 52 can be disposed as close to each other as possible in the centrally axial direction A2, whereby the dimensions of the internal combustion engine E can be reduced in the cylinder-head center line direction A1, as well as in the centrally axial one A2. As a result, the overall height of the internal combustion engine E can be reduced.

Described below will be an embodiment in which part of the aforesaid embodiment is modified only with respect to the modified portion.

While in the above embodiment one intake valve and one exhaust valve are provided for each combustion chamber $\mathbf{8}_1$ to $\mathbf{8}_4$, the invention maybe applied to an internal combustion engine in which a pair of intake valves and a pair of exhaust valves are provided for each combustion chamber. While the internal combustion engine in the above embodiment is the four-cylinder one, any other type of multi-cylinder internal combustion engine may be used.

What is claimed is:

1. A water-cooled internal combustion engine with cylinders and a crankshaft, comprising:

a cylinder block receiving said cylinders therein and defining a block-side coolant jacket; and a cylinder head connected to an upper portion of said cylinder block and defining a head-side coolant jacket, wherein coolant discharged from a coolant circulating pump is supplied to said block-side coolant jacket via said head-side coolant jacket, further wherein a first inlet port of said cylinder head through which said coolant discharged from said coolant circulating pump is allowed to flow into said head-side coolant jacket is provided at one end portion in a cylinder-head center line direction and an intake side of said cylinder head, further wherein a first outlet port of said cylinder head through which said coolant from said head-side coolant jacket is allowed to flow out into a heater core is provided at the other end portion in the cylinder-head center line direction and an exhaust side of said cylinder head, and wherein the first outlet port is formed to open in the cylinder-head center line direction.

2. The water-cooled internal combustion engine as set forth in claim 1, wherein an accommodating chamber for accommodating therein a thermostat is provided at said other end portion and an intake side of said cylinder head.

3. The water-cooled internal combustion engine as set forth in claim 2, further comprising:

a thermostat cover provided on a mount surface formed on said other end portion of said cylinder head, for covering said thermostat, wherein said accommodating chamber, said first outlet port, and a second outlet port through which said coolant from a main body of said internal combustion engine is allowed to flow out into a radiator are formed to open in said mount surface, said accommodating chamber being situated on an intake side and said first outlet port and said second outlet port being situated on an exhaust side of said mount surface, and wherein said thermostat cover forms an inlet passage through which coolant from said radiator is allowed to flow into said thermostat, a first outlet passage through which coolant from said first inlet port is allowed to flow out into said heater core and a second outlet passage through which coolant from said second outlet port is allowed to flow out into said radiator.

4. The water-cooled internal combustion engine as set forth in claim 3, wherein said thermostat cover is formed such that said second outlet passage is interposed between said inlet passage and said first outlet passage.

5. The water-cooled internal combustion engine as set forth in claim 3, wherein said first outlet port is formed to open in the cylinder-head center line direction.

6. The water-cooled internal combustion engine as set forth in claim 3, wherein said thermostat cover has a first cover portion defining said inlet passage and a second cover portion defining said first and second outlet passage and a flange portion formed between said first and second cover potions portions, and said flange portion forms a curved recessed portion at an upper end thereof.

7. The water-cooled internal combustion engine as set forth in claim 2, wherein said accommodating chamber has a second inlet port through which coolant from a radiator is allowed to flow into said thermostat and a third outlet port through which coolant within said accommodating chamber is allowed to flow into said coolant circulating pump, and wherein said second inlet port is formed to open in the cylinder-head center line direction, and said third outlet port is formed to open in a direction substantially normal to the cylinder-head center line direction.

8. A water-cooled internal combustion engine with cylinders and a crankshaft, comprising:

a cylinder block receiving said cylinders therein and defining a block-side coolant jacket; and a cylinder head connected to an upper portion of said cylinder block and defining a head-side coolant jacket, wherein coolant discharged from a coolant circulating pump is supplied to said block-side coolant jacket via said head-side coolant jacket, wherein a first inlet port of said cylinder head through which said coolant discharged from said coolant circulating pump is allowed to flow into said head-side coolant jacket is provided at one end portion in a cylinder-head center line direction and an intake side of said cylinder head, wherein a first outlet port of said cylinder head through which said coolant from said head-side coolant jacket is allowed to flow out into a heater core is provided at the other end portion in the cylinder-head center line direction and an exhaust side of said cylinder head, wherein an accommodating chamber for accommodating therein a thermostat is provided at said other end portion and an intake side of said cylinder head, and a thermostat cover provided on a mount surface formed on said other end portion of said cylinder head, for covering said thermostat, wherein said accommodating chamber, said first outlet port, and a second outlet port through which said coolant from a main body of said internal combustion engine is allowed to flow out into a radiator are formed to open in said mount surface, said accommodating chamber being situated on an intake side and said first outlet port and said second outlet port being situated on an exhaust side of said mount surface, and wherein said thermostat cover forms an inlet passage through which coolant from said radiator is allowed to flow into said thermostat, a first outlet passage through which coolant from said first inlet port is allowed to flow out into said heater core and a second outlet passage through which coolant from said second outlet port is allowed to flow out into said radiator.

9. The water-cooled internal combustion engine as set forth in claim 8, wherein said thermostat cover is formed such that said second outlet passage is interposed between said inlet passage and said first outlet passage.

10. The water-cooled internal combustion engine as set forth in claim 8, wherein said first outlet port is formed to open in the cylinder-head center line direction.

11. The water-cooled internal combustion engine as set forth in claim 8, wherein said thermostat cover has a first cover portion defining said inlet passage and a second cover portion defining said first and second outlet passage and a flange portion formed between said first and second cover portions, and said flange portion forms a curved recessed portion at an upper end thereof.

12. A water-cooled internal combustion engine with cylinders and a crankshaft, comprising:

a cylinder block receiving said cylinders therein and defining a block-side coolant jacket; and a cylinder head connected to an upper portion of said cylinder block and defining a head-side coolant jacket, wherein coolant discharged from a coolant circulating pump is supplied to said block-side coolant jacket via said head-side coolant jacket, wherein a first inlet port of said cylinder head through which said coolant discharged from said coolant circulating pump is allowed to flow into said head-side coolant jacket is provided at one end portion in a cylinder-head center line direction and an intake side of said cylinder head, wherein a first outlet port of said cylinder head through which said coolant from said head-side coolant jacket is allowed to flow out into a heater core is provided at the other end portion in the cylinder-head center line direction and an exhaust side of said cylinder head, wherein an accommodating chamber for accommodating therein a thermostat is provided at said other end portion and an intake side of said cylinder head, wherein said accommodating chamber has a second inlet port through which coolant from a radiator is allowed to flow into said thermostat and a third outlet port through which coolant within said accommodating chamber is allowed to flow into said coolant circulating pump, and wherein said second inlet port is formed to open in the cylinder-head center line direction, and said third outlet port is formed to open in a direction substantially normal to the cylinder-head center line direction.

* * * * *